US005328409A

United States Patent [19]

Marquardt

[11] Patent Number: 5,328,409

[45] Date of Patent: Jul. 12, 1994

[54] NOTE CADDY

[76] Inventor: Steven J. Marquardt, 9153 Sawyer Brown Rd., Nashville, Tenn. 37221

[21] Appl. No.: 146,691

[22] Filed: Nov. 1, 1993

[51] Int. Cl.[5] ..... B42D 1/00

[52] U.S. Cl. ..... 462/17; 281/3.1; 281/2

[58] Field of Search ..... 462/17, 7, 20; 281/2, 281/5, 16, 3.1

[56] References Cited

U.S. PATENT DOCUMENTS

| | | | |
|---|---|---|---|
| 1,199,170 | 9/1916 | Friend . | |
| 3,087,498 | 4/1963 | Vogel | 281/15.1 |
| 4,043,573 | 8/1977 | Griffin | 283/2 |
| 4,798,401 | 1/1989 | Grey | 462/20 |
| 4,907,904 | 3/1990 | Baldwin | 402/80 |
| 4,934,740 | 6/1990 | Drake | 462/17 |
| 4,974,983 | 12/1990 | Givati | 281/15.1 |
| 5,029,903 | 7/1991 | Pennock | 283/81 |
| 5,143,404 | 9/1992 | Flowers, Jr. | 281/21.1 |
| 5,143,466 | 9/1992 | Baldwin | 402/79 |

*Primary Examiner*—Mark Rosenbaum
*Assistant Examiner*—Willmon Fridie, Jr.
*Attorney, Agent, or Firm*—I. C. Waddey, Jr.

[57] ABSTRACT

Disclosed is a note caddy which includes a binder with several sheets. The sheets have perforated scoring to facilitate their removal from the binder. Further, the sheets are divided into sections by perforated scoring, and note panels are adhered to each section. Each note panel has a note surface and an adhesive surface. The note surface of the panels are designed to receive notes penned or penciled thereon by the user of the invention.

The carrier sheets are constructed in a manner to allow the adhesive surface of the panels to releasably adhere thereto; for example, the carrier sheets can have a release coating on them which will cause the adhesive of the adhesive surface of the panel to adhere to the carrier sheet but be removable from it with the adhesive remaining on the panel for use in thereafter adhering the panel to a file, ledger or the like. Thus, the panels, when removed from the carrier sheets, can then be transferred to a ledger, page or file dedicated to the topic of the notes made on the specific panel and the adhesive surface, which is pressure sensitive, will adhere to the ledger, page or file tightly for a permanent binding of the panel to the page.

4 Claims, 1 Drawing Sheet

NOTE CADDY

BACKGROUND OF THE INVENTION

The present invention relates generally to an article to facilitate the taking of notes during the course of meetings and telephone conversation and the direct transfer of such notes to files, notebooks or pages of paper dedicated to a single subject. The present invention relates more particularly to a note caddy which provides a convenient means for carrying adhesive backed note panels on one's person or in a brief case or the like, enabling the user to take notes on the segregated panels and then remove the notes from the note caddy and transfer them directly to a ledger, file or sheet dedicated exclusively to the subject matter of the note. The note is attached to the ledger, file or sheet by the adherence of the adhesive backed panel to the ledger.

Practically everyone has experienced the disruption of a telephone conversation, with respect to either a personal or business matter, when one cannot find a piece of paper on which to take notes. Likewise, frequently when a note pad or piece of paper is available, their exists the inconvenience of having notes directed to a variety of topics all on the same page when the notes later have to be transferred or rewritten to a file relating to the subject matter of the particular note.

The inconvenience of not having a note pad readily available is one that has been addressed on many, many occasions in a variety of ways. Note pads, "Post-Its" ® notes, tablets and the like can all be made available for the taking of notes in the course of a phone conversations, meetings or the like. However, note pads are generally difficult to maintain in a file or transfer to a file since they are too small to clip to a regular file through traditional means such as a two-hole binder clip. Notes taken on the back of business cards, napkins or the like get misplaced or lost. Larger note pads, including the standard $8\frac{1}{2} \times 11$ so-called "legal pads" are open invitations to take notes on several topics on the same sheet of paper. Again, the filing of such notes is difficult because it requires recopying the material relating to the various topics onto separate sheets so that they can be filed in separate files according to the subject matter of the individual topic. Those who are sufficiently organized to take the notes in a systematic fashion may try to tear a $8\frac{1}{2}$ sheet of paper into several pieces, depending on the topic covered on the portion of the sheet of paper, but still the filing of those notes is very inconvenient.

In light of the foregoing general discussion, it will be appreciated by those skilled in the art that in the course of day to day activities, individuals in their personal lives as well as their business lives regularly make graphic notes of important information or reminders of activities that require attention. One would expect that the most frequent occasion creating circumstances of the nature just described occurs during the course of telephone conversations. However, meetings, either planned or by chance, present the same dilemma. An individual, while talking over the phone or meeting with someone about either a personal or business matter, may want to make a note about something said in the conversation. The statement made during the conversation may include such information as the name of a person to contact, a telephone number or address of someone to contact, an appointment, or any variety of other types of information. During the course of that same telephone conversation, another topic may arise during which it becomes convenient to make a note regarding the subject matter of that second topic. Still a third topic may be discussed during the course of the conversation which would require further notes on the third topic on the same page.

One attempt to try to address the problem to which Applicant's invention is directed is disclosed in the patent to Pennock, U.S. Pat. No. 5,029,903 issued on Jul. 9, 1991. In the Pennock patent, a wallet size note pack is provided which includes a paper web, at least one side which is provided with a release coating and a plurality of low tack adhesive note sheets. The paper web includes at least two fold lines divided in the web into three substantially equal sized panels, each of which is provided with a plurality of low tack note sheets arranged in an orderly arrays. The product disclosed by Pennock is a step in the right direction but is lacking in certain respects. Specifically, the product can sometimes be too bulky for certain situations. It does not facilitate those occasions in which a single sheet of note panels would be desired, for example where the user wanted to put a sheet of note panels in his pocket to carry with him before initiating a brief telephone conversation. Applicant's note caddy is an improvement over the Pennock device because it has means to facilitate the tearing off of a single sheet of the panels or individual panels in those circumstances where a small number of the note panels are needed. Further, my invention contemplates a fast adhesive (as opposed to a low tack adhesive) on the back of the note panel. My invention is a part of an overall system to facilitate note taking to allow one to transfer notes taken on an individual panel to be transferred to a sheet dedicated to the subject matter of the particular note.

Applicant has addressed these deficiencies of the prior art and has developed a note caddy that overcomes these deficiencies in a practical, economical and efficient manner.

SUMMARY OF THE INVENTION

Applicant has developed a note caddy which includes a binder with several sheets. The sheets have perforated scoring to facilitate their removal from the binder. Further, the sheets are divided into sections by perforated scoring, and note panels are adhered to each section. Each note panel has a note surface and an adhesive surface. The note surface of the panels are designed to receive notes penned or penciled thereon by the user of the invention.

The sheets are constructed in a manner to allow the adhesive surface of the panels to releasably adhere thereto; for example, the sheets can have a release coating on them which will cause the adhesive of the adhesive surface of the panel to adhere to the sheet but be removable from the sheet with the adhesive remaining on the panel for use in thereafter adhering the panel to a file, ledger or the like. Thus, the panels, when removed from the sheet, can then be transferred to a ledger, page or file dedicated to the topic of the notes made on the specific panel and the adhesive surface, which is pressure sensitive, will adhere to the ledger, page or file tightly for a permanent binding of the panel to the page.

With this invention, the note caddy itself, a sheet of note panels or an individual note panel can conveniently be separated for carrying on one's person and to be available for note taking as the occasion may arise.

From the foregoing summary of Applicant's invention, it will be understood that it is an object of Applicant's invention to provide a note caddy that includes a number of panels on which notes can be taken and the panels can be removed from their carrier sheets and adhered to a transfer page dedicated to the subject matter of the specific note.

It is a further object of the present invention to provide a note caddy of the type described wherein a single carrier sheet of several note panels can be removed from the note caddy and perforated scoring is provided to facilitate the removal of the carrier sheet from the caddy.

It is a further object of the invention to provide a note caddy of the type just described where a single note panel can be removed from the note caddy and perforated scoring is provided on the carrier sheets to facilitate the removal of a single note panel.

It is a further object of the present invention to provide a note caddy wherein the individual panels have a binding adhesive on one side and that adhesive causes the note panel to adhere to the carrier sheet with the carrier sheet being treated so that the note panel can be removed, in tact, from the carrier sheet and fixed onto a transfer page dedicated to the subject matter of the notes on the note surface of the panel.

It is a further object of the present invention to provide a note caddy wherein the adhesive on the adhesive surface of the note panel is a binding adhesive such that once the panel is removed from the carrier sheet and pressed, adhesive surface down, onto the transfer page, the panel will be permanently adhered to the transfer page.

Further objects of the present invention will be more clearly understood when consideration is given to the accompanying drawings and the detailed description of the preferred embodiment.

DESCRIPTION OF THE PREFERRED EMBODIMENT

Figure 3:
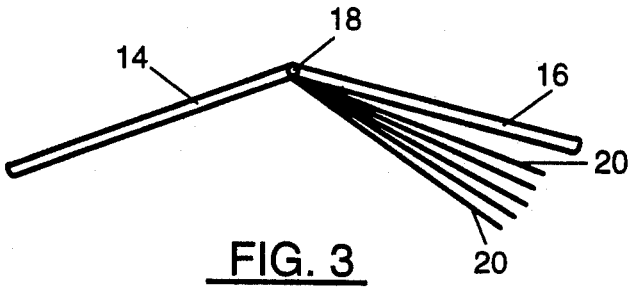
FIG. 3 is a top view of the note caddy.
Figure 1:
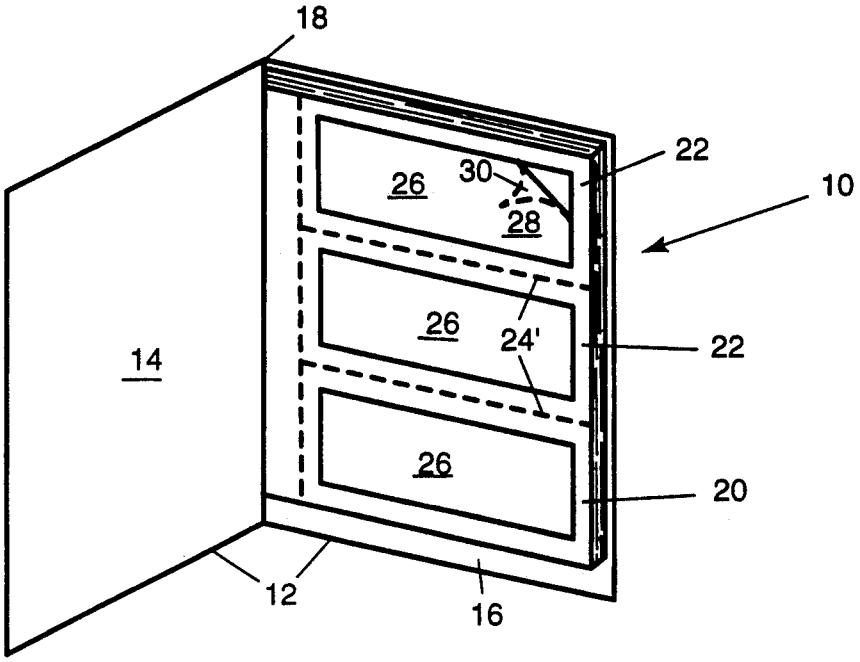
FIG. 1 is a perspective view of the note caddy of the present invention.

Referring now to FIG. 1, a perspective view of the note caddy of the present invention can be seen. Shown in FIG. 1 is note caddy 10 having a binder 12 which includes a front flap 14 and a rear flap 16.

The front flap 14 and the rear flap 16 are connected by a spine 18. Carrier sheets 20 of approximately the same size as the rear flap 16 are bound to the note caddy 10 along the spine 18. The carrier sheets 20 may be connected to the spine 18 of the caddy 10 by a traditional glue binding process or stapling (not shown). Also, an edge of the carrier sheets 20 may be provided with holes matching the spacing of a traditional ring binder with the carrier sheets 20 inserted into the binder 12 by the engagement of the rings of a traditional ring binder in the holes in the carrier sheets 20. Alternatively, the carrier sheets 20 could be bound in a note caddy having the structure of a traditional legal pad. In this embodiment, the carrier sheets 20 would be bound to the rear flap 16 by a glue or staple binding process along their top edge. Such a caddy could provide or eliminate the front flap 14 at the discretion of the user.

Referring again to FIGS. 1 and 2, the carrier sheets 20 have perforated scoring 24 running along a line parallel to the edge of the carrier sheets 20 that are bound to the spine 18 of the note caddy 10 so that one or more of the carrier sheets 20 may be torn along the line of the perforated scoring 24 and removed from the caddy. Tearing the carrier sheets 20 from the note caddy 10 will allow a user to place a full carrier sheet 20 in his pocket, brief case, legal pad, or the like, so that a single carrier sheet 20 could be carried with the user rather than having to carry the entire note caddy 10.

The carrier sheets 20 also have perforated scoring 24' along at least one additional line running perpendicular to the line of the perforated scoring 24. The perforated scoring 24' divides the carrier sheets 20 into two or more sections 22 (see FIG. 2). Because of the lines of perforated scoring 24, 24', an individual section 22 may be easily torn from the carrier sheets 20 and removed from the note caddy 10. Once one or more of sections 22 of the carrier sheets 20 are removed from the note caddy 10, once again, they may be placed in the user's pocket, in a briefcase, a legal pad or the like for use in taking notes as the occasion arises without having to carry the entire note caddy with the user.

To facilitate note taking and the direct relocating of individual notes made by the user, note panels 26 are provided on each section 22 of the carrier sheets 20 of the note caddy 10. The note panels 26 each have a note surface 28 on the front and an adhesive surface 30 on the back. Referring specifically to FIG. 1, one can see illustrated the note panels generally, and on the top note panel 26, the front and back constituting the note surface 28 and the adhesive surface 30. Each note panel 26 is similarly constructed.

The adhesive surface 30 includes a binding adhesive which will allow the panel to be fixedly attached to a separate ledger, file, sheet, page, or the like (such separate ledger, file, sheet, page or the like being hereinafter referred to as a "transfer page") dedicated to the notes that are written on the note surface 28 of a particular note panel 26. The adhesive surface 30 is releasably attached to the carrier sheets 20 because the carrier sheets 20 are treated with a release coating. However, because of the treatment of the surface of the carrier sheets 20 (which normally makes the carrier sheets 20 more difficult to tear and makes any tearing that might be attempted without the scoring more difficult to control), it is important to have the perforated scoring 24, 24'. Thus, the perforated scoring 24, 24' facilitates tearing the carrier sheets 20 from the note caddy 10 and further separating the sections 22 of the carrier sheets 20.

The release coating that is provided on the carrier sheets 20 can be one of any of a variety of known treatments giving the carrier sheets 20 a substantially impervious surface so that the adhesive coating will not fixedly adhere to it. This treatment gives the carrier sheets 20 a "wax" like feel to which the panels will adhere lightly because the adhesive will have some binding capacity, but will not adhere in a fixed or permanent fashion because the slick or impervious character of the treated surface of carrier sheets 20. Thus, the panel are attach to the carrier sheets 20 but can be easily removed from them with the binding adhesive on the adhesive surface 30 remaining on adhesive surface 30 to allow the panel to be relocated directly to a transfer page. The relocated panel will adhere in a permanent, fixed manner to the transfer page because the adhesive remaining on the adhesive surface 30 is pressure sensitive and sticks to the transfer page when pressed onto it.

Figure 2:
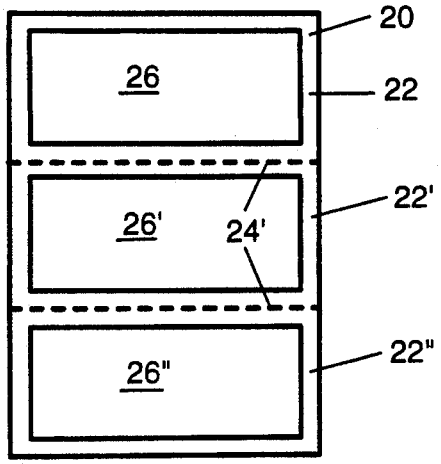
FIG. 2 is a front view of one of the carrier sheets of the note caddy separated from the note caddy.

FIG. 2 shows a single carrier sheet 20 of the note caddy 10 that has been removed from the note caddy 10 by tearing it along the line of perforated scoring 24. The carrier sheet 20 has sections 22, 22' and 22" which are created by the lines of perforated scoring 24'. Panels 26, 26' and 26" are contained within the sections 22, 22' and 22" of the carrier sheet 20. Thus, in the example shown in FIG. 2, the user will have three note panels which he/she can carry with him/her, place in his/her pocket to be used when taking notes during the course of a telephone conversation or otherwise be available for note taking in the course of personal or business conversations or activities.

In operation, the note caddy provides a particularly useful organizational tool. Specifically, when one carries the note caddy with him, he can take notes on a variety of subjects on the note surface 28 of the panels 26, simply recording notes about each new topic or subject matter on a separate panel. Later, when the user of the note caddy returns to his office or home where he may have a file or other organizational system relating to the various topics which were discussed during his phone conversation or meeting, he can remove the panels 26, 26', 26" from the carrier sheet 20 and then fixedly attach each panel to the transfer page dedicated to the subject matter of the notes taken on each individual panel. This will avoid the problem of having to recopy the notes onto the transfer page, or having to photocoping a note page several times and putting a copy of the note page in each file relating to the various topics about which notes had been taken, or having to get a pair of scissors and cut a single sheet of paper into several sections and then taping the sections onto a sheet dedicated to the subject matter of the notes in the individual sections. Applicant's invention allows a user to remove a single sheet from the note caddy and the line of perforated scoring will cause the panel to tear in a straight line and not destroy the usefulness of the sheet. Further, individual sections of a single sheet can be separated and carried with the user without having to carry the entire note caddy to a phone conversation or into a meeting. Still, notes about various topics can be taken on one sheet of paper, simply making notes with respect to each topic on a separate panel with the panels later removed from the carrier sheets and fixedly adhered to a transfer page dedicated to the subject matter of the individual note on the individual panel. Applicant's invention is a substantial advantage over devices designed to address this problem and disclose in the prior art and is an organization facilitator unlike any other presently available.

Having described the preferred embodiment of my invention, the scope of the invention will be more clearly defined in the following claims wherein:

What I claim is:

1. A note caddy including:

a. a binder with at least one support flap;

b. multiple carrier sheets;

c. said multiple carrier sheets having multiple edges;

d. said carrier sheets being bound along at least one of their edges and to said support flap to form a spine of the note caddy;

e. each carrier sheet having a first line of perforated scoring running substantially parallel to said spine and adjacent thereto whereby the sheet may be torn along the first line of perforated scoring and removed from the note caddy;

f. at least one second line of perforated scoring running perpendicular to the first line of perforated scoring, said second line of perforated scoring dividing said carrier sheets into two or more sections;

g. note panels;

h. said note panels having a front and back surface;

i. the front surface of each of said note panels constituting a note surface onto which the user may scribe notes relating to a particular topic;

j. the back surface of each of said note panels having an adhesive coating creating an adhesive surface which will adhere the panels to the carrier sheets;

k. a panel adhered to each section; and l. said carrier sheets treated with means whereby the panels may be removed from the carrier sheets with the adhesive surface in tact so that the panels may be relocated to a transfer page dedicated to the subject matter of the notes taken on each individual panel.

2. The note caddy as claimed in claim 1 wherein the means with which said carrier sheets are treated is a release coating.

3. The note caddy as claimed in claim 1 wherein the adhesive coating on the back surface of each of said note panels is a fast adhesive.

4. The note caddy as claimed in claim 2 wherein the adhesive coating on the back surface of each of said note panels is a fast adhesive.

* * * * *